US006672624B2

(12) United States Patent
Fabel

(10) Patent No.: US 6,672,624 B2
(45) Date of Patent: Jan. 6, 2004

(54) MAILING FORM FOR NON-IMPACT PRINTING

(75) Inventor: Warren M. Fabel, Delray Beach, FL (US)

(73) Assignee: Laser Substrates, Inc., Boca Raton, FL (US)

( * ) Notice: Subject to any disclaimer, the term of this patent is extended or adjusted under 35 U.S.C. 154(b) by 0 days.

(21) Appl. No.: 09/557,492

(22) Filed: Apr. 24, 2000

(65) Prior Publication Data

US 2002/0149196 A1 Oct. 17, 2002

Related U.S. Application Data

(63) Continuation-in-part of application No. 09/243,003, filed on Feb. 2, 1999, now Pat. No. 6,173,888, which is a continuation-in-part of application No. 08/480,161, filed on Jun. 7, 1995, now Pat. No. 5,865,717, which is a continuation-in-part of application No. 09/488,067, filed on Jan. 19, 2000, now Pat. No. 6,482,085, which is a continuation-in-part of application No. 09/179,224, filed on Oct. 27, 1998, now Pat. No. 6,095,919.

(51) Int. Cl.[7] ..... B42D 15/00

(52) U.S. Cl. ..... 283/116; 283/72; 283/61; 283/62; 229/92.8

(58) Field of Search ..... 283/116, 61, 62, 283/117; 229/303, 92.1, 92.8; 462/64, 65, 6; 493/216, 222

(56) References Cited

U.S. PATENT DOCUMENTS

| | | | | | |
|---|---|---|---|---|---|
| 3,894,684 | A | * | 7/1975 | Florey | 229/92.8 |
| 4,681,253 | A | * | 7/1987 | Engelhart | 229/92.8 |
| 5,464,255 | A | * | 11/1995 | Schildmeyer | 283/116 |
| 5,595,404 | A | * | 1/1997 | Skees | 283/62 X |
| 5,791,553 | A | * | 8/1998 | Fabel | 229/92.1 |
| 5,836,622 | A | * | 11/1998 | Fabel | 283/62 |
| 5,865,717 | A | * | 2/1999 | Fabel | 493/216 |

* cited by examiner

*Primary Examiner*—Willmon Fridie, Jr.
(74) *Attorney, Agent, or Firm*—Ted W. Whitlock

(57) ABSTRACT

A mailing form constructed of a single ply of substrate material which is configured such that it can be folded to form a financial document, such as an accounts payable or payroll check and check voucher, and wherein the ply is further folded to form an outgoing mailer envelope in which the financial document is enclosed for mailing to a recipient.

17 Claims, 8 Drawing Sheets

MAILING FORM FOR NON-IMPACT PRINTING

CROSS-REFERENCE TO RELATED APPLICATIONS

This is a continuation-in-part of U.S. patent application Ser. No. 09/243,003, filed Feb. 2, 1999, now U.S. Pat. No. 6,173,888, which is a continuation-in part of U.S. patent application Ser. No. 08/480,161, filed Jun. 7, 1995, now U.S. Pat. No. 5,865,717, issued Feb. 2, 1999, and is a continuation-in-part of U.S. patent application Ser. No. 09/488,067, filed Jan. 19, 2000, now U.S. Pat. No. 6,482,085, which is a continuation-in-part of U.S. patent application Ser. No. 09/179,224 filed Oct. 27, 1998, now allowed now U.S. Pat. No. 6,695,919.

FIELD OF THE INVENTION

This invention related to mailing forms, and more particularly, to mailing forms which, after information is printed thereon by a simplex, non-impact printer, can be folded into an outgoing mailer containing a printed document.

BACKGROUND OF THE INVENTION

Non-impact printers, such as laser or ink jet printers, are being increasingly used to provide a fast, economical, and convenient method of printing data developed within computer systems and stored in databases. An important example of this kind of data is accounting data of both large and small organizations. In most organizations, preparing and distributing accounts payable, e.g., payroll checks or other financial documents, e.g., tax or stock information, invoices, statements, or the like, represents a significant effort, as such account data is printed and distributed in envelopes.

Whereas many invoices, monthly statements, renewal notices, questionnaires and the like arrive in a single envelope together with a number of other printed documents such as a return envelope and a response document, certain payments or periodic informational mailings do not require a response from the receiver of the information. Accordingly, providing a single form which includes a payment check or other financial document or information, and which can be folded to provide an outgoing mailer envelope, all printable in a single pass through a simplex, non-impact printer, can be advantageous by reducing labor and material expenses.

Multi-part forms, including envelopes in which documents are sent, together with the documents themselves, have been manufactured for use in impact printers. Such forms are typically assembled into webs with sprocket holes extending along one or both lateral edges to facilitate handling through a pin feed impact printer. Transferable coatings are selectively placed on one or more of the sheets making up the assembly, so that impact printing forces are transferred to produce characters on intermediate document surfaces. This approach has further been modified to provide a remittance envelope, in which various materials, such as a check and a portion of the statement, may be returned to the organization sending the statement.

However, with the increasing popularity of non-impact printers, especially among small organizations, the percentage of organizations having the impact printers necessary to use such multi-part forms is decreasing. Therefore, what is needed is a mailing form configured for use with non-impact printers. However, such forms do not have flexibility and capability of forms developed for use with non-impact printers. Furthermore, such forms often must be processed through automatic folding/sealing machines to be used in a practical manner. Such automatic folding machines are other examples of equipment not available to many small organizations. Therefore, what is needed is a mailing form which is pre-folded and therefore can be easily prepared by the user with or without the further use of a folding machine.

A number of different types of forms include flaps or pockets provided in a closed configuration which must be opened at a later time. See, for example, U.S. Pat. No. 5,633,071, issued to Moore Business Forms, Inc. However, this patent describes a form having the disadvantage of not providing Information Based Indicia (IBI) or showing of a Facing Indicating mark (FIM) per the requirements of the U.S. Postal Service (USPS). Other forms which provide an outgoing mailer containing a report or payroll check required at least two sheets or plies or have further disadvantages which are overcome by the subject invention.

A mailing form providing advantages that are absent from the currently available forms, including (1) providing a combination outgoing mailer envelope and financial document (e.g., a payment check) produced from a single ply of paper stock, (2) provide for electronic postage, including Information-Based Indicia (IBI) and FIM indicia and automatic positioning of same, and (3) providing these in a form which does not require the use of folding/sealing equipment by the user, is needed in the art

SUMMARY OF THE INVENTION

In accordance with one aspect of the invention, there is provided a mailing form constructed of a single ply of substrate material which is configured such that it can be folded to form a financial document, such as an accounts payable or payroll check and check voucher, and wherein the ply is further folded to form an outgoing mailer envelope in which the financial document is enclosed for mailing to a recipient. Certain features of this embodiment are described in related U.S. patent application Ser. No. 09/243,003, its parent, U.S. Pat. No. 5,865,717, U.S. patent application Ser. No. 09/488,067, and its parent application, U.S. patent application Ser. No. 09/179,224, all of which are hereby incorporated by reference.

One general advantage of the subject invention is to provide a user with a form which is of a standard size for printing on a standard non-impact printer, but which is actually an oversized form which would not normally be printable on a standard non-impact printer. another generally advantageous aspect of the subject invention is to provide a mailer which can be used for sending secured documents, i.e., a mailer having features which maintains the security for the contents, e.g., financial documents such as a check or tax document, contained within the mailer.

The mailer form of the subject invention is constructed from a single ply of substrate material, such as paper stock commonly used in the industry, having standard width, e.g., 8½ inches and meeting banking and postal requirements. The length of the form should be long enough to provide separable sections of the form which can be folded in a manner to provide a front and back ply for an outgoing mailer envelope and a financial document, such as a standard check and voucher document, each of which are vertically aligned in the extended (pre-folded) configuration. Typically, then, the ply is about 20 to 21 inches in length (the width dimension in reference to the web) in its extended configuration.

The substrate ply includes perforation or score lines horizontally dividing the form into each of these sections and providing fold lines for folding each of the sections into the final folded configuration. One section of the outgoing mailer envelope preferably includes cut-out areas, or "windows" for viewing of address information and postage indicia printed on a corresponding face of the form which, when the form is folded to form the outgoing mailer envelope, mates with the inner face of the outgoing mailer envelope front ply to show through the windows. The inner face of the outgoing mailer envelope front ply also includes a transparent backing sheet to protect the contents contained within the mailer envelope.

Additional features of the subject invention include certain die-cuts which provide removable protective strips which, when removed, advantageously expose adhesive patternly disposed on the form for sealing the outgoing mailer envelope, and additional perforations providing tear-off strips which can facilitate folding of the form into a completed mailer or can facilitate opening of the sealed mailer by the recipient.

A further advantage provided by the subject invention includes a form which is manufactured and provided to the user in a unique, pre-folded configuration such that mailing information can be printed on a simplex, non-impact printer and the form further processed by the user to produce a mailer envelope having a financial document such as a check and voucher contained therewithin. The further processing by the user does not require use of a folder/sealer equipment.

BRIEF DESCRIPTION OF THE DRAWINGS

Preferred embodiments of the subject invention are hereafter described with specific reference being made to the following figures.

DETAILED DESCRIPTION

The present invention concerns a one-way (non-response) mailer which can include a check or other financial documents. The subject invention, although generic in that it can be adapted for use with a variety of documents, can be preferably used to generate accounts payable and payroll checks for a plurality of recipients using a single inventory of forms. The subject invention is manufactured using appropriate check paper stock as a web approximately 20½ inches in width (form length). The web can then be printed with a pantograph if desired for use with financial documents which require security. A transparent backing sheet is adhered to a section of the web, which is then plow folded to a width approximately 14 inches in length.

The subject invention can be understood by reference to the accompanying drawings attached hereto and the description of the Figures.

Figure 1:
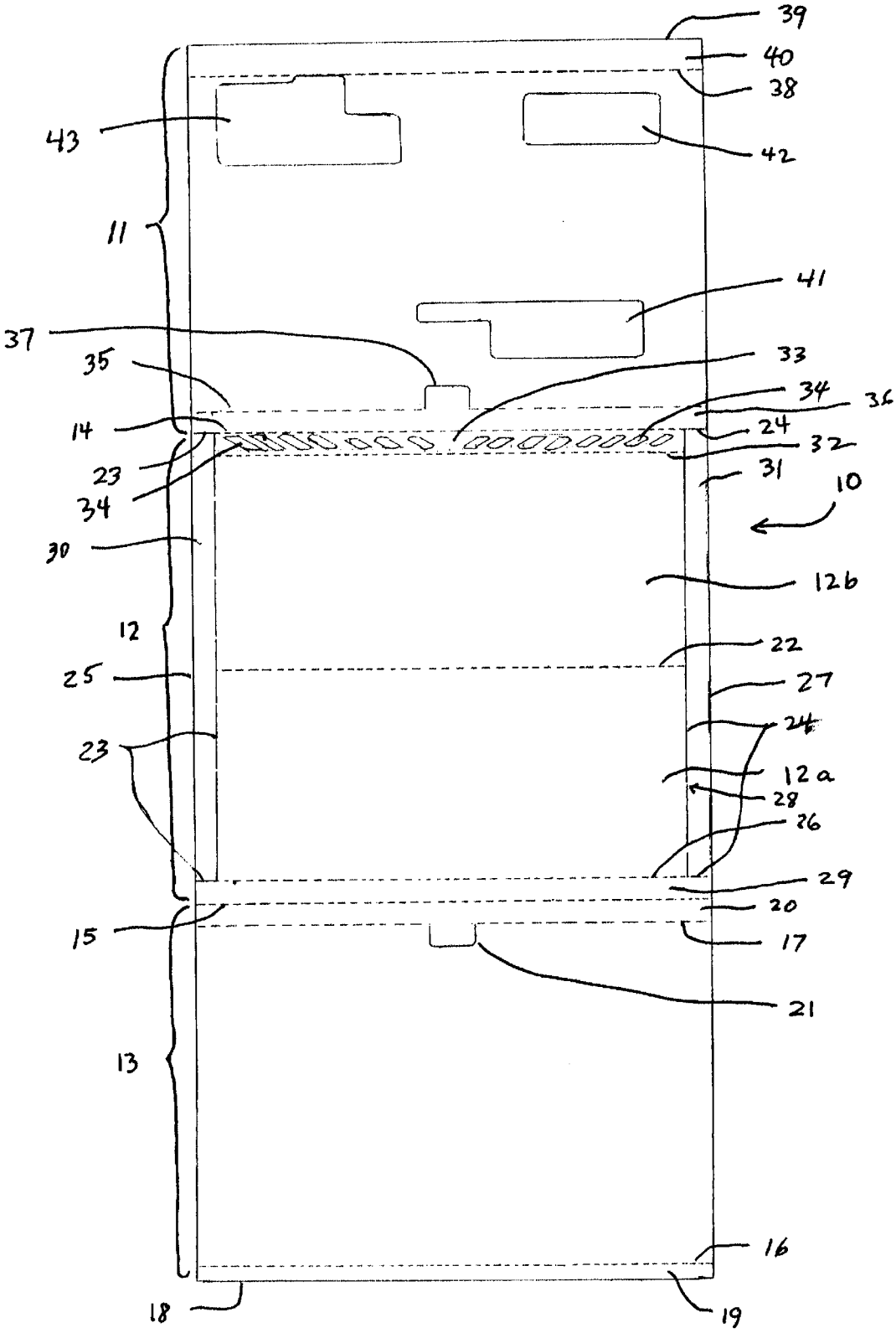
FIG. 1 is a plan view of a front face of the mailing form made in accordance with the present invention, showing die-cuts and perforations provided therein, which form the various features and sections of the form.

FIG. 1 shows a plan view of a front face of the single-ply mailing form 10 in its extended configuration. This front face is the face on which printed information can be provided by a single pass through a simplex, non-impact printer. This front face is therefore the interior portion of the outgoing mailer envelope and its contents. Mailing form 10 comprises mailer envelope front ply section 11, document section 12, and mailer envelope back ply section 13, vertically aligned with one another and divided from one another by horizontal perforations 14 and 15.

Mailer envelope back ply section 13 includes horizontal perforation 16 parallel to and approximately ¼ of an inch from end edge 18. This perforation provides extension strip 19 which allows printing of postage indicia flush with this perforation, avoiding a ¼ inch non-printable border left by most non-impact printers. Extension strip 19 is foldable along perforation 16 such that the postage indicia is within ⅛ inch or less from the top edge of the mailer envelope, as preferred by the U.S. Postal Service (USPS). Mailer envelope back ply section 13 also includes perforation 17, parallel to and approximately ¼–¾ of an inch from perforation 15. Removable tear-off strip 20 is thereby formed between perforations 15 and 17 and allows for removal of strip 20 by the recipient in opening the folded and sealed mailer envelope. In the preferred embodiment shown in FIG. 1, perforation 17 can be formed such that the perforated portion does not span the entire width of the form. Instead, perforation 17 includes a substantially "U"-shaped or "notched" die-cut 21 centrally formed therein to provide a tab in section 13 which can be removed when tear-off strip 20 is removed. Removal of this tab creates a "thumb notch" which can facilitate removal of contents of the mailer envelope by providing the recipient access to those contents using a thumb and/or finger.

Document section 12 provides an area for printing a document which can then be folded such that it is contained within the front and back ply sections of a folded mailer envelope. Preferably, section 12 can include a perforation 22 which divides section 12 in half, forming separable sections 12*a* and 12*b* of equal size and meeting applicable banking size requirements. It is desired to have these sections 12*a* and 12*b* separable from one another when the document section 12 is used, for example, to provide a check and voucher. One of sections 12*a* and 12*b* can be printed as the check, and the other of these sections can be printed as the detail listing or voucher. This perforation 22 also can facilitate folding by the user so that sections 12*a* and 12*b* can be folded over one another for containment within the mailer envelope. Because the mailing form 10 can be generic, i.e., allowing a variety of documents to be printed for use, perforation line 22 can be optional. When a perforation line 22 is not provided, however, a score or fold line is present to facilitate folding of section 12 by the user.

Perforation 26 is formed in document section 12 parallel and approximately ¼ to ¾ inches, preferably ⅜ inches, interior (relative to document section 12) to perforation 15. This perforation forms tear-off strip 29 which mates with tear-off strip 20 when the mailer envelope is folded and sealed. Tear-off strip 29 can be removed by the recipient, along with tear-off strip 20 when opening the mailer envelope.

Document section 12 further comprises die-cut 23 formed parallel and approximately ¼ to ¾, preferably ⅜, inches interior to side edge 25 of document section 12. This die-cut 23 is shown to continue perpendicular to the side edge 25 and contiguous with a portion of perforations 14 and 26 at each end of the die-cut. Similarly, die-cut 24 is formed parallel and approximately ¼ to ¾, preferably ⅜, inches interior to the opposite side edge 27 of document section 12, and also is shown to continue perpendicular to side edge 27 and contiguous with a portion of perforations 14 and 26. These die-cuts preferably have areas which are not completely cut, known in the art as paper "ties." These are illustrated as incomplete die-cut lines as shown, for example, in tie 28 in FIG. 1.

Die-cut 23 provides a removable "chip-out" area 30 which is automatically removed by the user prior to forming the mailer envelope. Advantageously, as described herein below, the chip-out area can be removable as part of a single action when removing the protective ring for exposing adhesive. Die-cut 24 provides a similar chip-out area 31 on the opposite edge of document section 12.

Document section 12 further comprises perforation 32 which is formed between die-cuts 23 and 24, parallel and approximately ¼ to ¾, preferably ⅜, inches interior (relative to section 12) to perforation 14. Between perforations 14 and 32 is formed a removable tear-off strip 33 in the front ply of the mailer envelope 11. This tear-off strip 33 corresponds to and mates with previously described tear-off strips 20 and 29 when the mailer envelope is folded and sealed. This removable tear-off strip 33 is also removed by the recipient in opening the mailer. Preferably, within this tear-off strip 33 are further provided a plurality of die-cut "voids" 34, which, when removed, expose adhesive disposed on a mated strip, allowing the adhesive to contact, through tear-off strip 33, another mated strip when the mailer envelope is folded and sealed. These voids are shown in FIG. 1 as a series of slanted die-cuts which is a preferred configuration for providing maximum exposure of adhesive while maintaining strength and integrity of the strip 33 during processing. It would be understood that a variety of other configurations, shapes, or sizes could be utilized for these cut-out areas which provide similar advantages.

Mailer envelope front ply section 11 comprises perforation 35, parallel to and approximately ¼ to ¾, preferably ⅜, inches interior (relative to section 11) to perforation 14. This perforation provides removable tear-off strip 36 which allows removal of strip 36 for opening the folded and sealed mailer envelope by the recipient. In the preferred embodiment shown in FIG. 1, perforation 35 can be formed such that the perforated portion does not span the entire width of the form. Instead, perforation 35 includes a substantially "U"-shaped, or "notched" die-cut 37 centrally formed therein to provide a removable tab in section 11 when tear-off strip 36 is removed. This tab can facilitate removal of contents of the mailer envelope by providing thumb and/or finger access to those contents by the recipient. This perforation 35 having "notched" area 37 is preferably formed as a mirror image to perforation 17 and notch area 21 such that they mate and form aligned perforation lines 17 and 35 on the respective back and front ply sections of the mailer envelope.

Mailer envelope front ply 11 further comprises perforation 38 parallel and approximately ½ to ¾ inches interior to top edge 39, forming therebetween a sealer flap 40 for the mailer envelope. Perforation 38 provides a fold line for folding over the sealer flap by the user when sealing the mailer envelope. Advantageously, the form provides for a mailer envelope which meets size requirements of the USPS. Currently, the USPS requires a mailer envelope to be 6⅛ inches or less in height. The subject invention is dimensioned such that it provides a mailer envelope which is 6 inches in height in its final folded and sealed configuration.

In addition, this mailer envelope front ply section 11 includes die-cut window areas 41, 42, and optionally, 43 which allow viewing of printed information therethrough when the mailer envelope is folded and sealed. Window 41 provides for viewing addressee (recipient) address information; window 42 provides for viewing return address (user address) information; and window area 43 provides for viewing of postal indicia. Window 41 is shown in its preferred configuration as a "stepped" window, i.e., wider in at least one dimension, to accommodate bar-coded information in accordance with certain USPS regulations. Similarly, window 43 is also shown in a preferred "stepped" configuration. The postage indicia window 43, however, is shown in a most preferred configuration having a stepped area in two dimensions. The stepped area which meets perforation 38 provides for a facing identification mark (FIM) to be positioned flush with the top edge of the mailer envelope (perforation 38, when folded and sealed). In addition, a second stepped area can be provided in a perpendicular direction to allow for a 2-dimensional bar-code to be printed. These configurations can be particularly advantageous for use with PC Postage.

Figure 2:
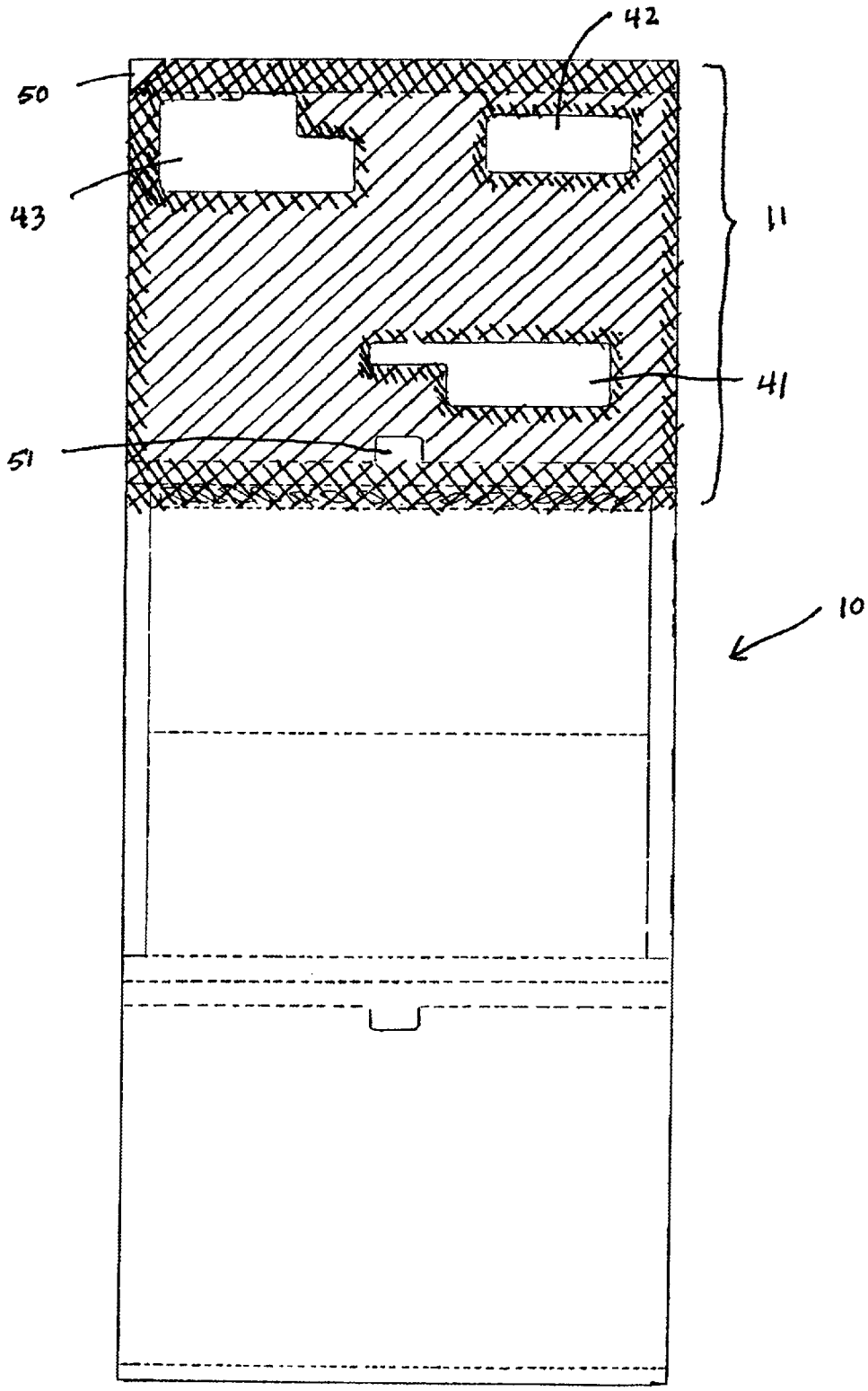
FIG. 2 is a plan view of a front face of the mailing form shown in FIG. 1, showing the various die-cuts and perforations provided in the form, and further illustrating the areas where adhesive is disposed thereon.

FIG. 2 is a plan view of a front face of the mailing form 10 shown in FIG. 1, showing the various die-cuts and perforations provided in the form, and further illustrating the areas where adhesive material (hatching) is disposed on the face of mailer envelope front ply section 11. The diagonal hatching is shown to illustrate that the adhesive can be patternly disposed, e.g., striatedly disposed, in order to provide effective adhesion with a minimal amount of adhesive applied. Cross-hatching is shown to illustrate the areas, e.g., around the perimeter edges of section 11 and around the window areas 41, 42, and 43 formed therein, where a solid coating of adhesive is preferred in order to provide a maximum bonding of the adhesive to prevent separation between the ply and an overlying transparent backing sheet. In addition, two areas are adhesive-free—a corner area 50 remains adhesive-free in order to facilitate removal of a portion of the transparent backing sheet, and tab area 51 remains adhesive-free in order to facilitate its removal by the recipient and to not adhere t the mailer envelope contents (document section 12).

Figure 3:
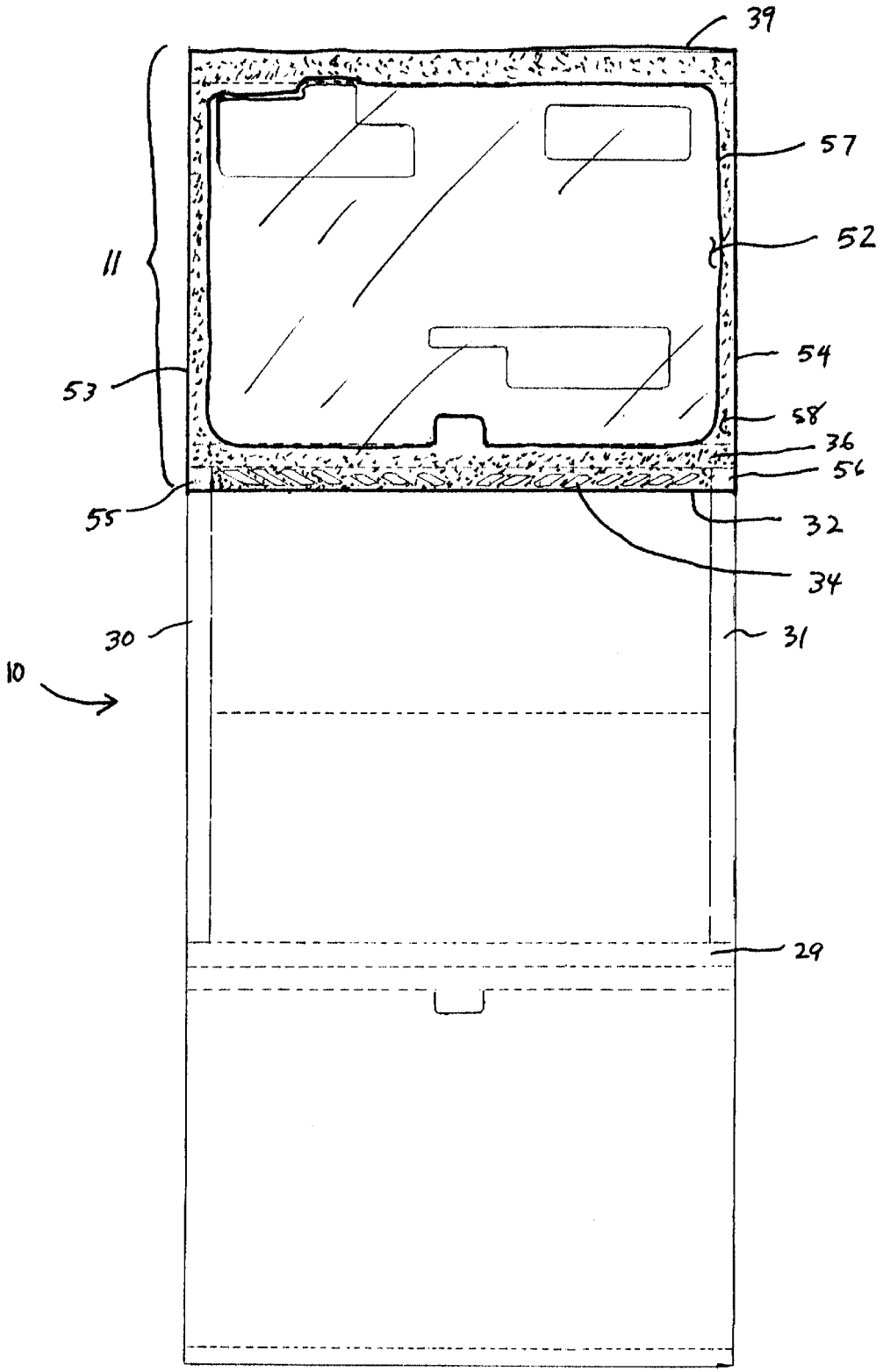
FIG. 3 is a plan view of a front face of the mailing form shown in FIG. 1, showing the various die-cuts and perforations provided in the form, and further illustrating the placement of a transparent backing sheet overlying the inner face of the section forming the front ply of the outgoing mailer envelope.

FIG. 3 is a plan view of a front face of the mailing form 10 shown in FIG. 1, showing the various die-cuts and perforations provided in the form, and further illustrating the placement of a transparent backing sheet 52, approximately 1 mil in thickness, overlying the inner face of the outgoing mailer envelope front ply section 11. Preferably, the transparent backing sheet is a static-free plastic or polymer material, which advantageously is heat-resistant and prevents static buildup when processed through a laser printer. The transparent backing sheet 52 preferably extends from top edge 39 to perforation line 32 and from respective side edges 52 and 53. FIG. 3 further illustrates a die-cut 57 formed around the interior perimeter edge of transparent backing sheet 52, forming a removable, substantially rectangular protective ring 58, which exposes adhesive on the front face of outgoing mailer envelope front ply section 11 when removed by the user. Removal of the protective ring is facilitated by adhesive-release material (stippling) patternly disposed between the transparent backing sheet 52 and the adhesive disposed on section 11.

Within this protective ring area, adhesive-release material is not disposed in areas 55, 56, and in void areas 34 in order to allow contact of the adhesive disposed on outgoing mailer envelope front ply section 11 for adherence to the underlying paper stock. Accordingly, when the protective ring 58 is removed during use, void areas 34 are removed with the protective ring leaving open areas so that adhesive disposed in tear-off strip 36 contacts and adheres to its corresponding section 29 (back face) mated thereto when the mailer envelope is folded and sealed. In addition, the absence of release material at corner sections 55 and 56 allows for total adhesion of the transparent backing sheet 52 with chip-out areas 30 and 31. Therefore, removal of the protective ring 58 simultaneously removes these chip-out areas, and void areas 34, by a single action by the user, advantageously leaving the remaining portion of the transparent backing sheet 52 to protect the interior and contents of the mailer envelope. Adhesive-release material may also be avoided in the areas corresponding to the corner area 50 and tab 51 since no adhesive is disposed in these areas.

The adhesive and adhesive-release materials are well known in the art and are commercially available. Preferably, the adhesive is a permanent, pressure-sensitive adhesive. Silicon is commonly used in the industry for providing releasable bonding of adhesive and would be a preferred adhesive-release material. It would also be understood that the adhesive material would preferably be disposed such that a gap is provided approximately 1/32 to 1/64 inch along any edge to prevent oozing of the material.

Figure 4:
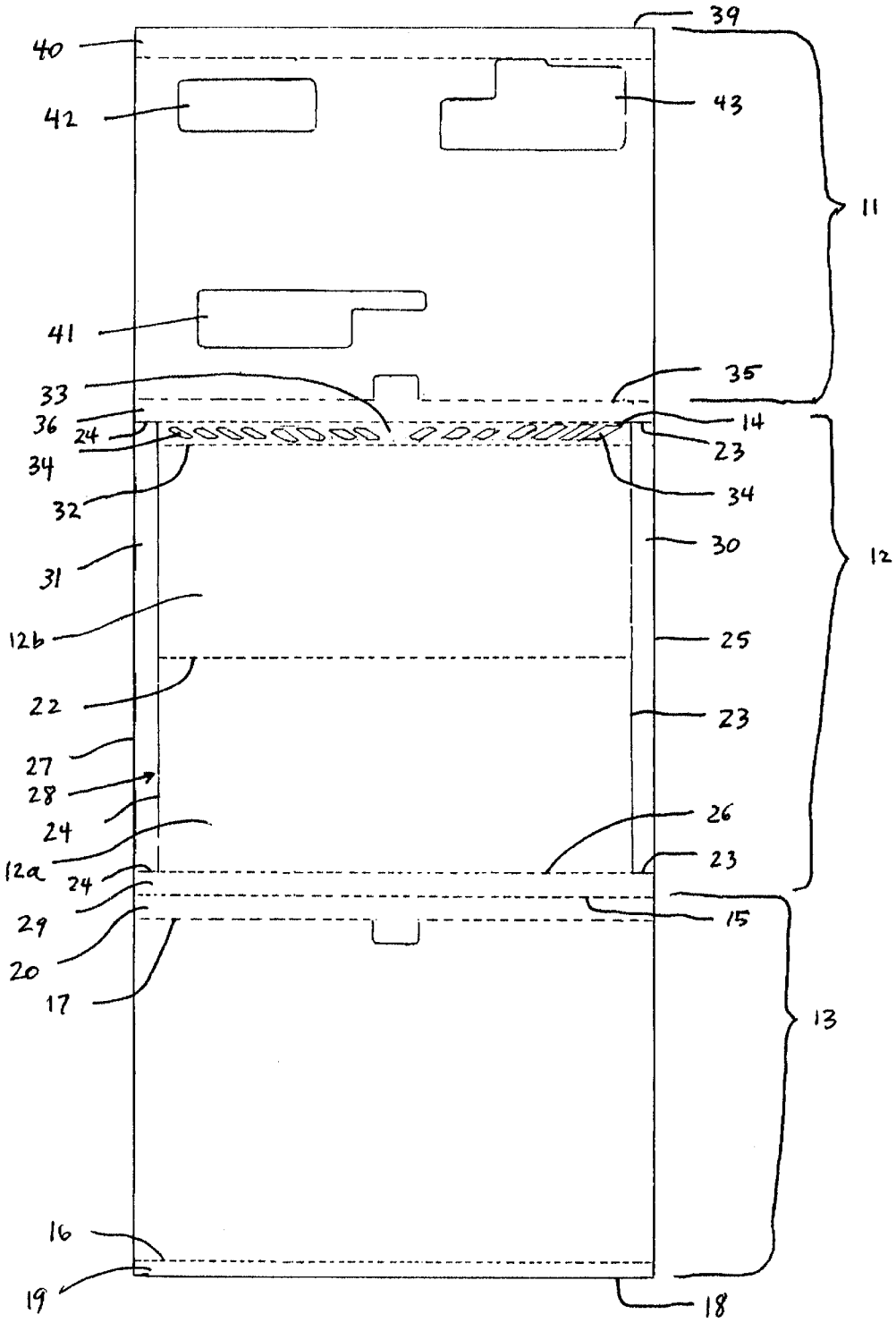
FIG. 4 is a plan view of a back face of the mailing form shown in FIG. 1, showing the various die-cuts and perforations provided therein, which form the various features and sections of the form.

FIG. 4 is a plan view of a back face of the mailing form 10 shown in FIG. 1, showing the various die-cuts and perforations provided therein, which form the various features and sections of the form. The back face is a mirror image of the front face of the form.

Once the form is manufactured, it can be pre-printed with instructions for use on any convenient location, e.g., on the back face of the back mailer envelope section 13. For security purposes, the inner faces of the mailer envelope can also be pre-printed with a pantograph to prevent viewing of the contents within the envelope. A security pantograph can also be printed on the document section to prevent alteration or other manipulation of the document. A printed pantograph is illustrated in FIG. 6

Figure 5:
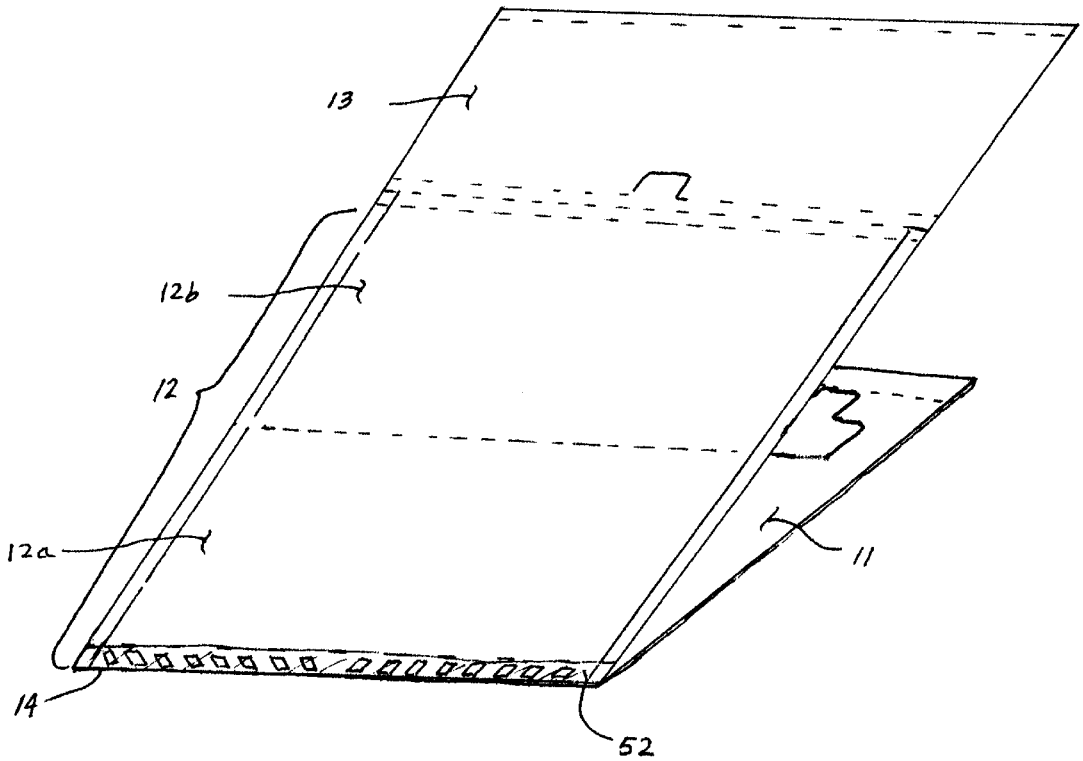
FIG. 5 shows the form in a pre-folded configuration as preferably provided to the user.

Referring to FIG. 5, the manufactured form is preferably plow-folded along perforation 14 whereby the back face of mailer envelope front ply section 11 is plow-folded to meet and contact the back face of document section 12. The form is preferably provided to the user in this configuration, wherein the transparent backing sheet 52 overlying perforation 14 provides a leading edge of the form for feeding through a simplex, non-impact printer. This plow-fold results in a form approximately 14 inches in length, and having mailer envelope front ply section 11 is attached only along the fold line 14, allowing section 11 to freely hang in relation to the rest of the form. The inventor refers to this configuration as a "hanging tail" configuration. For use in certain printers, e.g., a laser printer, it is preferred to include a matte varnish coating along at least one face of the leading edge of the transparent sheet 52 to provide adequate surface friction and facilitate feeding of the form through the feeder mechanism of the printer.

The form in this hanging tail configuration can then be printed by the user wherein the voucher information and recipient address information is printed on the printing (front) face of document section 12*a*, the check or other information is printed in the appropriate area of the printing (front) face of document section 12*b*, and return address information and PC Postage indicia are printed in the appropriate areas of the printing (front) face of mailer envelope back ply section 13. Appropriate positioning of the information on each of these sections can be achieved using available software, or by adapting available software for such purposes.

Figure 6:
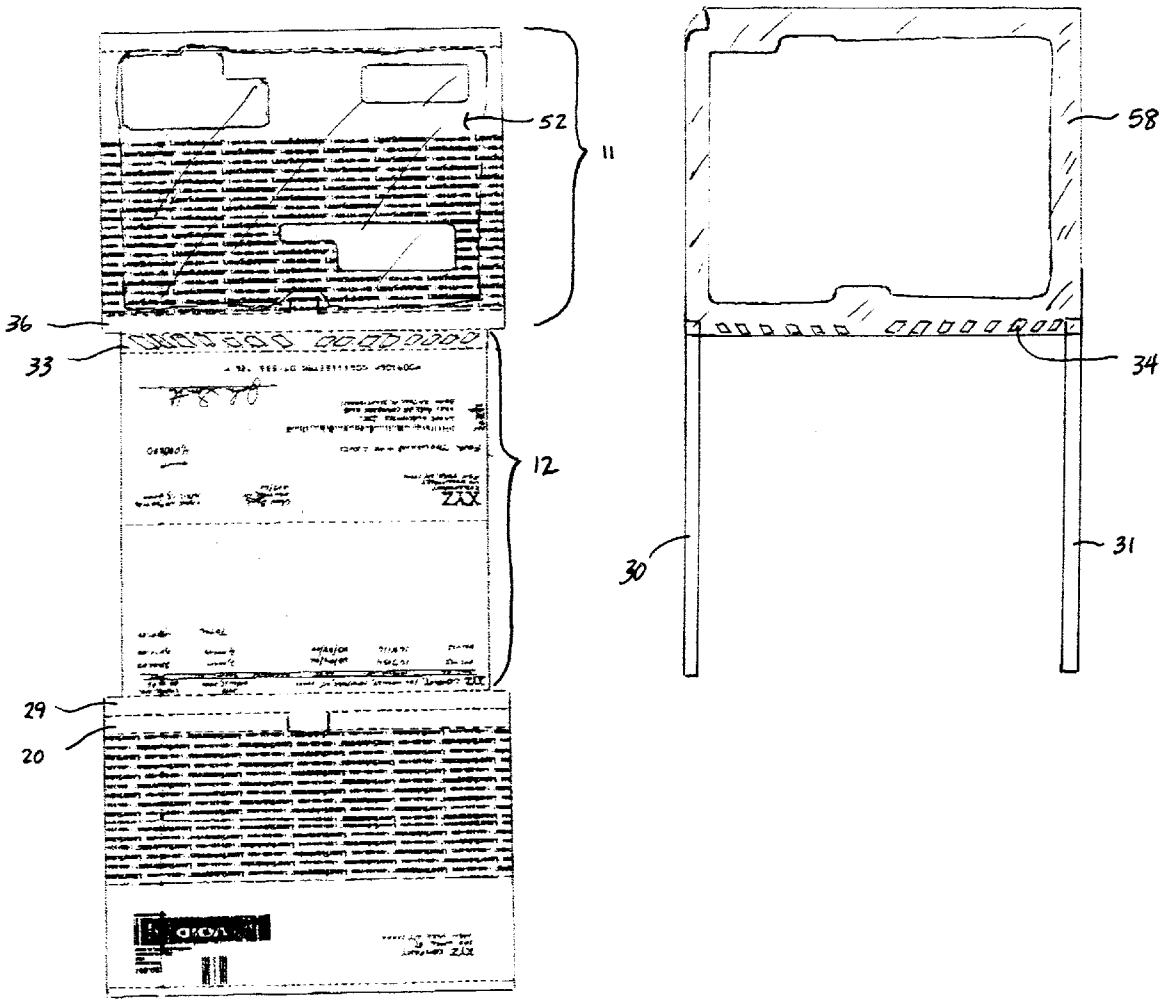
FIG. 6 shows a printed form, having edge strips removed, and further illustrating a pantograph for security of the form and document contained therein.

As shown in FIG. 6, once printed by the non-impact printer, mailer envelope top ply section 11 can be unfolded such that the form is in its completely extended configuration. Protective ring 58 is then removed, simultaneously removing void areas 34 and edge strips 30 and 31. The removal of edge strips 30 and 31 advantageously provides for a freely enclosed document section 12, which can be easily removed from within the mailer envelope after end tear-off strips 20, 29, 33, and 36 are removed.

Figure 7:
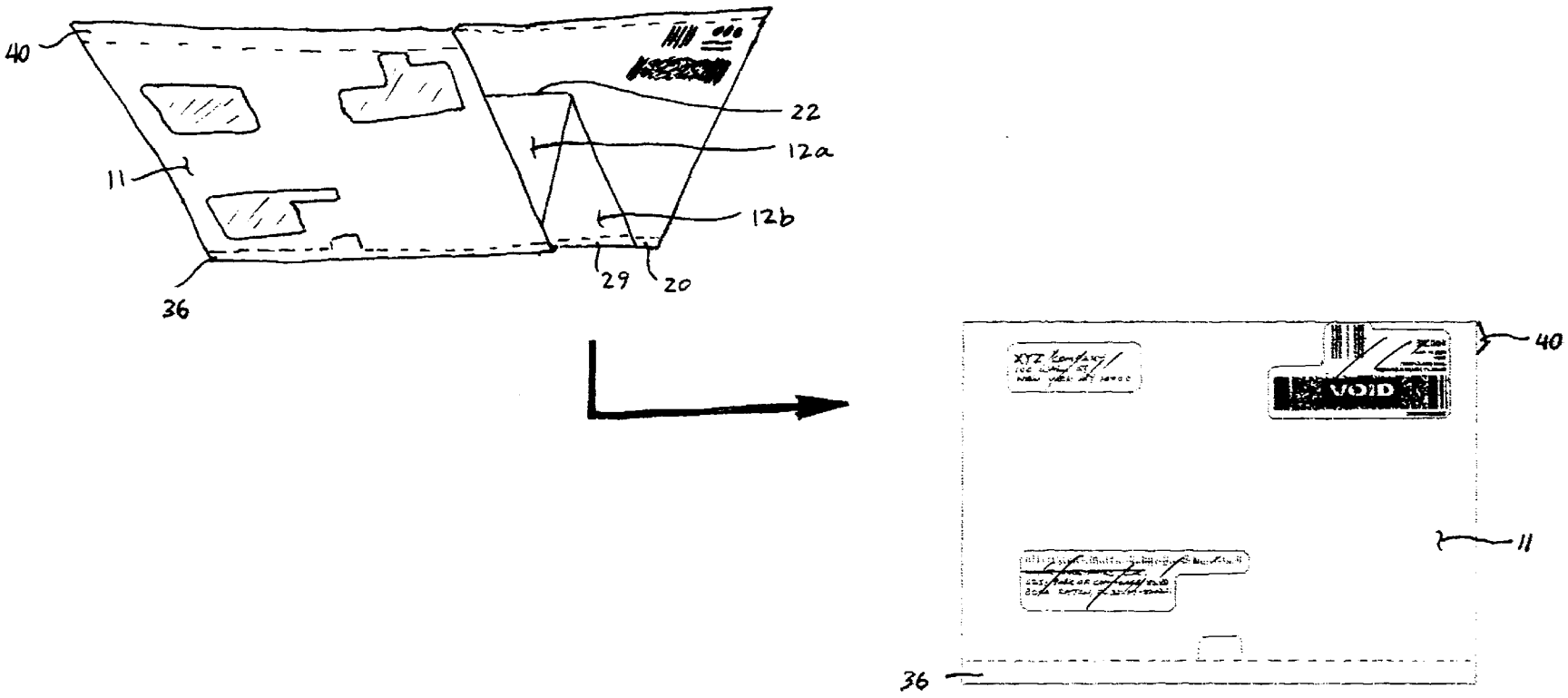
FIG. 7 illustrates, is a step-wise fashion, the steps for folding and sealing procedure by the user.

The steps for folding and sealing of the form by the user are illustrated in FIG. 7. The form can be folded along perforation 22, such that document sections 12*a* and 12*b* contact one another at their respective back faces. The mailer envelope front and back ply sections are folded inwardly along perforations 14 and 15 such that document section 12 is nested within the mailer envelope sections 11 and 13. The mailer envelope therefore is four plies thick (superimposed tear-off strips 20, 29, 33, and 36) at its bottom edge when in its final folded configuration.

Adhesive exposed on mailer envelope section 11 by removal of protective ring 58 can then contact each of the side edges of the corresponding face of mailer envelope section 13 for forming a seal at the side edges of the envelope formed thereby. Adhesive exposed on seal flap 40 at the top edge of mailer envelope section 11 is used to contact the back face of mailer envelope back ply section 13 to seal the envelope. Significantly, adhesive exposed on tear-off strip 36 is allowed to contact the back face of tear-off strip 29, through the removed void areas 34. Thus, mailer envelope form 10, in its folded configuration, is sealed around its entire perimeter and can be sent to the recipient.

Figure 8:
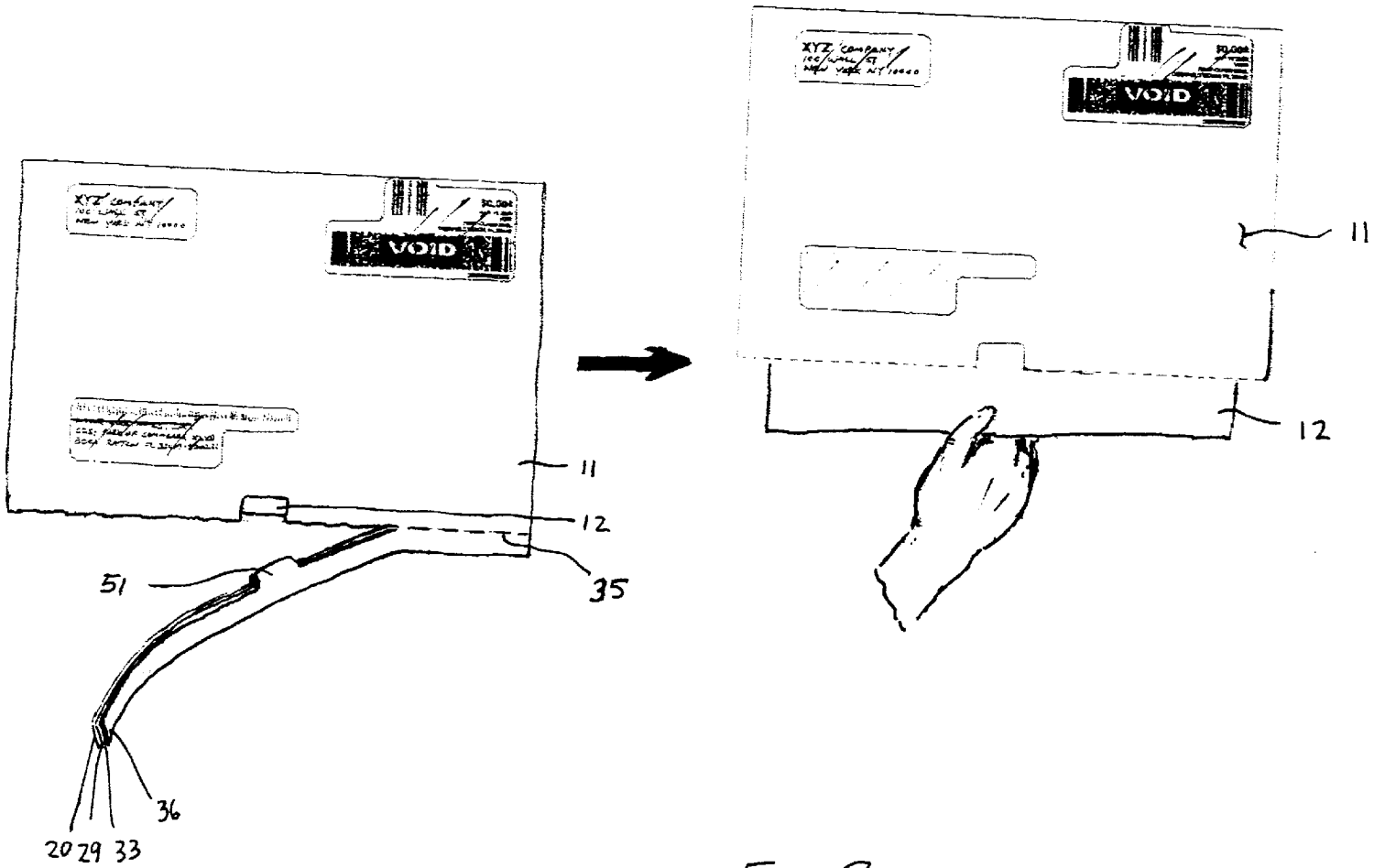
FIG. 8 illustrates, in step-wise fashion, the steps for opening of the mailer and accessing the contents of the mailer by the recipient.

The steps for opening of the mailer and accessing the enclosed document by the recipient are illustrated in FIG. 8. When the mailer is received by the recipient, all four superimposed plies of tear-off strips 20, 29, 33, and 36 can be removed simultaneously by tearing along perforations 35, 32, 26, and 17, which are also superimposed in the folded and sealed configuration. Removal of these tear-off strips also separates the document section 12 from the sealed mailer envelope and removes tab 51 and its corresponding tab on the mailer envelope back section 13. Thus, document section 12 is freely contained within the mailer envelope and can be easily removed by accessing the document section 12 via the removed tab area 51. Removal of the document section 12 by the recipient allows the recipient to then separate document sections 12*a* from 12*b*.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

What is claimed is:

1. A mailing form comprising a single ply of substrate material having adhesive patternly disposed thereon for sealing, wherein said substrate material comprises at least three horizontal perforations which divide said substrate into four distinct panels, said panels comprising a first and second end panel and a first and second intermediate panel, said substrate being foldable and sealable to form an outgoing mailer from the first and second end panels and a financial document from the first and second intermediate panels, wherein said financial document is contained within said folded and sealed outgoing mailer and wherein the form further comprises a single ply of transparent material overlying an inner face of said first end panel for protecting the contents of the mailer when folded and sealed.

2. The mailing form of claim 1, wherein said first end panel forms a front ply section of the outgoing mailer and said second end panel forms a back ply section of the outgoing mailer when the form is in its folded configuration.

3. The mailing form claim 2, wherein said financial document section foldably divides into a payment portion and a voucher portion.

4. The mailer form of claim 1, wherein the form comprises further perforations which provide tear-off strips for opening of a sealed mailer by a recipient of the mailer.

5. The mailing form of claim 3, wherein the payment portion is a check.

6. The mailing form of claim 1, wherein the substrate material is paper check stock in accordance with banking requirements.

7. The mailing form of claim 2, wherein the outgoing mailer front ply section includes window areas for viewing printed information therethrough.

8. The mailer form of claim 1, wherein the transparent material is heat and static resistant.

9. The mailer form of claim 1, wherein the transparent material ply comprises a die-cut forming a removable protective ring having adhesive-release material patternly disposed thereon, wherein said adhesive-release material allows removal of the protective ring which exposes adhesive disposed on the substrate ply.

10. The mailer form of claim 9, wherein the protective ring is permanently affixed to certain portions of the underlying substrate material whereby those affixed portions of the underlying substrate material are automatically removed upon removal of the protective ring.

11. The mailer form of claim 10, wherein the removed portions of the underlying substrate material are side strips and void areas formed in the financial document section.

12. The mailer form of claim 4, wherein said further perforations are configured to provide a notched area, forming a tab which is automatically removed with the tear-off strips, exposing the contents of the mailer such that said contents are accessible and removable from the mailer by a recipient.

13. The mailing form of claim 1, wherein all variable information printed on the form is printable by a single pass through a simplex, non-impact printer.

14. The mailing form of claim 1, wherein the form is printed with a security pantograph.

15. The mailing form of claim 14, wherein the security pantograph is printed on at least one interior face of the mailer to prevent viewing of contents within the mailer.

16. The mailing form of claim 14, wherein the security pantograph is printed on the financial document to prevent alteration of the financial document.

17. The mailing form of claim 1, wherein the form is plow-folded to provide a pre-folded form for a user.

* * * * *